US008684490B2

(12) United States Patent
Takagi et al.

(10) Patent No.: US 8,684,490 B2
(45) Date of Patent: Apr. 1, 2014

(54) IMAGE FORMING APPARATUS, METHOD OF PROCESSING IMAGE, AND COMPUTER-READABLE RECORDING MEDIUM

(75) Inventors: Yasunobu Takagi, Kanagawa (JP); Toshihito Kamei, Tokyo (JP); Takayuki Ito, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 171 days.

(21) Appl. No.: 13/316,991

(22) Filed: Dec. 12, 2011

(65) Prior Publication Data

US 2012/0147082 A1 Jun. 14, 2012

(30) Foreign Application Priority Data

Dec. 13, 2010 (JP) ..... 2010-277404

(51) Int. Cl.
*B41J 29/393* (2006.01)
*B41J 29/38* (2006.01)

(52) U.S. Cl.
USPC ..... 347/19; 347/15

(58) Field of Classification Search
CPC ..... B41J 2/2054; B41J 2/2132
USPC ..... 347/9, 12, 14, 15, 19, 40, 43
See application file for complete search history.

(56) References Cited

U.S. PATENT DOCUMENTS

2006/0214968 A1 9/2006 Chiwata
2009/0179934 A1 7/2009 Takagi et al.
2009/0225121 A1 9/2009 Miyamoto
2009/0244154 A1 10/2009 Miyamoto
2010/0182366 A1 7/2010 Takagi et al.
2010/0182367 A1 7/2010 Takagi et al.

FOREIGN PATENT DOCUMENTS

JP 2004050445 A 2/2004
JP 2009234115 A 10/2009
JP 2011116096 A 6/2011

OTHER PUBLICATIONS

European Search Report dated Mar. 26, 2012, issued in corresponding Application No. 11193200.0-1251.
Abstract of JP 2011-116096 published Jun. 16, 2011.
Abstract of JP 2009-234115 published Oct. 15, 2009.
Abstract of JP 2004-050445 published Feb. 19, 2004.

*Primary Examiner* — An Do
(74) *Attorney, Agent, or Firm* — Harness, Dickey & Pierce, P.L.C.

(57) ABSTRACT

An image forming apparatus includes a joint head in which a plurality of heads, each having a plurality of nozzles, are arranged in a nozzle arranging direction, and end portions of the heads adjacent to each other overlap, an overlap processing unit that distributes recording dot pattern data used for forming dots by using nozzles of an overlapping portion of the heads out of recording dot pattern data to the nozzles of the recording head adjacent to each other, a first tone correcting unit that performs tone correction, by a first correction characteristic, on recording dot pattern data using the nozzles other than the overlapping portion, and a second tone correcting unit that performs tone correction by a second correction characteristic on recording dot pattern data by using the nozzles of the overlapping portion.

6 Claims, 14 Drawing Sheets

IMAGE FORMING APPARATUS, METHOD OF PROCESSING IMAGE, AND COMPUTER-READABLE RECORDING MEDIUM

CROSS-REFERENCE TO RELATED APPLICATIONS

The present application claims priority to and incorporates by reference the entire contents of Japanese Patent Application No. 2010-277404 filed in Japan on Dec. 13, 2010.

BACKGROUND OF THE INVENTION

1. Field of the Invention

The present invention relates to an image forming apparatus, a method of processing an image, and a computer-readable recording medium thereof. The invention more particularly relates to an image forming apparatus with a joint head in which a plurality of heads overlap each other at their end portions, each head includes a plurality of nozzles arranged in a predetermined direction, and the plurality of heads are arranged in a direction in which the nozzles are arranged, and relates to a method of processing an image.

2. Description of the Related Art

In an inkjet recording system, by using a recording head having ink tanks and nozzles which communicate with the ink tanks, and applying pressure to ink in the ink tanks in accordance with image information, ink droplets are allowed to fly from the nozzles and thus to be attached to a recording medium such as a paper sheet or a film to thereby form an image. Since an image forming apparatus (inkjet printer) employing the inkjet recording system forms an image in a non-contacting manner by discharging ink from the recording (print) head, it has a feature of being able to record an image on various types of recording media.

Ink jet printers are largely categorized into line type (line printer) and serial type (serial printer).

The line printer is a printer that forms an image by arranging a recording head in a fixed manner in which nozzles are arranged, the nozzles are arranged in almost the entire range of the width of a sheet. This type of printer conveys a paper sheet at high speed and forms an image over the entire area of the sheet width by single scanning, and accordingly, the productivity is very high. On the other hand, since the type of printer needs to form an image by single scanning, there is a disadvantage that an ejection defect or the like of the head is directly reflected on the image quality. In addition, since the mounting of a head having a length extending over a sheet width causes many problems such as a low yield and the like, in practical applications, the length of the sheet width is generally covered by using a joint head acquired by aligning, in the main-scanning direction, a plurality of heads each of which having a plurality of nozzles arranged in the main-scanning direction (sheet width direction), and accordingly, there are problems in the image such as color unevenness or a stripe that is caused by a difference in the features of the heads or an assembly error.

On the other hand, the serial printer is a type of printers that forms an image by reciprocating a recording head in a direction (main-scanning direction) perpendicular to the sheet conveying direction (sub-scanning direction). Since the serial printer forms an image by performing scanning a plurality of times, the resolution can be increased in a relatively easy manner, and low cost and the miniaturization thereof can be easily realized, therefore serial printers are widely used. However, since the formation of an image for printing one paper sheet is performed through scanning a plurality of times, the productivity of the serial printer is lower than that of the line printer. Thus, recently, in order to improve the productivity of the serial printer, it is a known fact that a higher speed is achieved by increasing width of the head in the sub-scanning direction thereby increasing the printable width (a length in the sub-scanning direction) through single scanning, or by using a joint head acquired by aligning, in the sub-scanning direction, a plurality of heads each of which having a plurality of nozzles arranged in the sub-scanning direction (sheet conveying direction). In such a case, even in a serial printer, similarly to the case of a line printer, there are problems that are inherent in a joint head such as a difference in the features of the plurality of heads and misalignment in the assembly.

Hereinafter, the problems in the joint head will be described in detail.

In the joint head, a plurality of heads are connected together, and accordingly, a fluctuation in the size, the shape, the landing position, or the like of discharged dots may occur due to a manufacturing fluctuation of the head or the driving system, whereby there is a possibility that density unevenness from head to head occurs. In order to solve this problem, there is a technique (Japanese Patent Application Laid-open No. 2009-234115) in which the input/output characteristics are corrected by performing the correction of the input/output characteristics of the individual heads. As an example of the correction, there is a method in which input/output correction is performed in γ correction or the like. This is, for example, a target density is approached by decreasing the output tone (gray scale, gradation) of a thick head from a reference to decrease the density, and increasing the output tone of a thin head from the reference to increase the density.

For example, as illustrated in FIG. 15, in a case where a head α has large discharge dots and a head β has small discharge dots for the same input data, there is a difference in the density (shading) like a dot pattern D1, and a color difference between the heads is created. Thus, the dot arrangement of the head α is changed to be sparser, and the dot arrangement of the head β is changed to be denser, whereby the densities are approached. This may be performed by using one head as a reference and correcting the other head or by correcting both heads to have the same target density. The latter case in which the characteristics of each head are adjusted to ideal image characteristics is more preferable. A dot pattern D2 is formed by approaching the characteristics of the head β to those of the head α.

At this time, when described in more detail, as can be understood from the example of the dot pattern D2, the number and the type of dots arranged on a sheet surface are changed. In a monitor such as a cathode ray tube (CRT) or a liquid crystal, although tones of multiple levels, for example 256 tones, can be represented by using one pixel by adjusting the luminance, the number of colors of ink that can be mounted in an inkjet printer is only about one to eight, and there is limitation of about one to three types such as black, dark gray, light gray, and the like on similar colors, and accordingly, it is difficult to represent the tones by changing the density (size) of each dot alone. Accordingly, the density (shading) is represented based on the amount of ink attached per unit area of a recording medium. By controlling the number of dots in a binary printer that can discharge dots of only one size and by controlling the number and the size of the dots in a printer in which the number of dots and a plurality of sizes (for example, four values of a large droplet, a medium droplet, a small droplet, and no droplet) can be handled, the amount of attachment of ink per unit area is controlled so as to represent a tone. Accordingly, γ correction in the inkjet printer is to control the arrangement of dots (the number and the size of dots) per unit area (for example, the number of thrown dots is decreased in a case where the dot is larger than a target dot, and the number of thrown dots is increased in a case where the dot is smaller than a target dot).

Accordingly, in a case where the γ correction (tone correction) of the input/output characteristics is performed as in the dot pattern D2, although the density is the same in a macroscopic view, there is a slight difference in the arrangement of dots, and that may cause that the conversion of the texture is visually noticeable. In addition, as for colors, even when the density is uniform, there may be a case where the hue differs. For example, when comparing a case where a small number of large dots are arranged and a case where a large number of small dots are arranged, even when the densities are at the same level, there may be a case where a change in the hue or saturation occurs due to the penetration characteristics of ink so as to have different impressions of the color. In addition, in the case of a color that is represented by overlapping a plurality of colors such as a multi-order color, since the tinge is adjusted by using a method of arranging dots, therefore, even when the tinge is adjusted in each color, there may be a case where the way colors are overlapped is changed so that the way of exposition of the colors can not be controlled, or there may be a case where, due to the difference in the way of penetrating, the tinge can not be controlled.

In addition, a stripe due to positional misalignment is another problem of the printer in which a joint head is mounted. When the heads are arranged in a joined manner, due to an assembly error of the heads, there occurs uneven density of the dots discharged from the joint portion of the heads, and density unevenness in a stripe shape occurs. In addition, such a stripe may be generated due to the discharge of ink from nozzles itself, and there are many cases where particularly an end portion of the head has discharge characteristics different from those of other portions due to the generation of crosstalk, an air current, or the like, and accordingly, discharge banding or discharge skipping may easily occur therein. Furthermore, in the case of a color that is represented by overlapping a plurality of colors such as a multi-order color, since the tinge is adjusted by using a method of arranging dots, therefore, even when the tinge is adjusted in each color, there may be a case the way colors are overlapped is changed so that the way of exposition of the colors can not be controlled, or there may be a case where, due to the difference in the way of penetrating, the tinge can not be controlled.

As means for solving such problems, there is an overlap processing technique. The technique has features in which end portions of heads configuring the joint head physically overlap each other, and the overlapping portion forms an image by forming dots by using nozzles of both heads in a shared manner. Thus, since the characteristics of the nozzles of the two heads adjacent to each other are mixed in dots formed by the overlapping portion, the problem of a stripe can be alleviated. For example, in Japanese Patent Application Laid-open No. 2004-50445, relating to the overlap processing technique, a technique is disclosed in which a nozzle from which dots are formed is determined based on a random number.

Particularly in a line printer, since there are many heads that configure the joint head, it is difficult to perform position adjustment in the joining portion of all the heads at high precision. In addition, since it is difficult to perform multi-pass printing in which an image is formed by a plurality of scanning operations in the line printer, the landing misalignment of the dots on a sheet due to assembly misalignment of the heads, discharge banding of ink, or the like may easily affect the image. Accordingly, in the printer in which such a joint head is mounted, this technique is used together with the above-described tone correcting technique for each head in many cases.

However, when the tone correction for each head and the overlap processing between adjacent heads are simply performed together, there may be still a case where a density (shading) stripe is generated in the overlapping portion. in other words, in a case where it is divided, for example, at the center of the overlapping portion and tone correction operations that are appropriate for the head a and the head β are respectively performed, although the overlap processing is performed in the overlapping portion, on the head α side and the head β side, discharged dots that are optimized for the other head side are present. Accordingly, the overlapping portion is formed to be thin or thick, and as a result, there is a case where a density stripe is generated in the overlapping portion.

In other words, as illustrated in FIG. 16, in a case where a discharged dot of the head α is large, and a discharged dot of the head β is small, when discharge data is changed by the center of the overlapping portion (joint portion), as illustrated in the dot pattern D3, the dot arrangement is sparse in a portion onto which only the head α discharges ink, and the dot arrangement is dense in a portion onto which only the head β discharges ink. In the joint therebetween, on the head α side, although small dots discharged by the head β are mixed, the dot arrangement may be a sparse arrangement, which is optimized for the head α, so as to have a low density, and, on the head β side, although large dots discharged by the head α are mixed, the dot arrangement may be a dense arrangement, which is optimized for the head β, so as to have a high density.

There is a need to solve such problems. There is a need to prevent the generation of a density stripe.

SUMMARY OF THE INVENTION

It is an object of the present invention to at least partially solve the problems in the conventional technology.

An image forming apparatus including: a joint head in which a plurality of heads, each having a plurality of nozzles arranged in a predetermined direction, are arranged in a nozzle arranging direction, and end portions of the heads adjacent to each other overlap; an overlap processing unit that distributes recording dot pattern data used for forming dots by using nozzles of an overlapping portion of the heads adjacent to each other out of recording dot pattern data to the nozzles of the recording head adjacent to each other; a first tone correcting unit that performs tone correction, by a first correction characteristic determined in advance for each of the heads, on recording dot pattern data used for forming dots using the nozzles other than the overlapping portion, out of the recording dot pattern data; and a second tone correcting unit that performs tone correction by a second correction characteristic on recording dot pattern data used for forming dots by using the nozzles of the overlapping portion, wherein the second correction characteristic is an intermediate correction characteristic of the first correction characteristics of the heads adjacent to each other.

A method of processing an image that is used in an image forming apparatus having a joint head in which a plurality of heads having a plurality of nozzles arranged in a predetermined nozzle arranging direction, and end portions of the heads adjacent to each other overlap, the method including: distributing recording dot pattern data used for forming dots by using nozzles of an overlapping portion of the heads adjacent to each other out of recording dot pattern data to the nozzles of the recording head adjacent to each other; and performing tone correction, by a first correction characteristic determined in advance for each of the heads, on recording dot pattern data used for forming dots using the nozzles other than the overlapping portion, out of the recording dot pattern data, and performing tone correction by a second correction characteristic on recording dot pattern data used for forming dots by using the nozzles of the overlapping portion, wherein the second correction characteristic is an intermediate correction characteristic of the first correction characteristics of the heads adjacent to each other.

A non-transitory computer-readable recording medium having a program including instructions for causing a computer to execute an processing of an image by an image forming apparatus having a joint head in which a plurality of heads having a plurality of nozzles arranged in a predetermined nozzle arranging direction, and end portions of the heads adjacent to each other overlap, the instructions including: distributing recording dot pattern data used for forming dots by using nozzles of an overlapping portion of the heads adjacent to each other out of recording dot pattern data to the nozzles of the recording head adjacent to each other; and performing tone correction, by a first correction characteristic determined in advance for each of the heads, on recording dot pattern data used for forming dots using the nozzles other than the overlapping portion, out of the recording dot pattern data, and performing tone correction by a second correction characteristic on recording dot pattern data used for forming dots by using the nozzles of the overlapping portion, wherein the second correction characteristic is an intermediate correction characteristic of the first correction characteristics of the heads adjacent to each other.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment of the invention will be described with reference to the drawings.

Configuration of Mechanism Portion of Image Forming Apparatus

Figure 1:
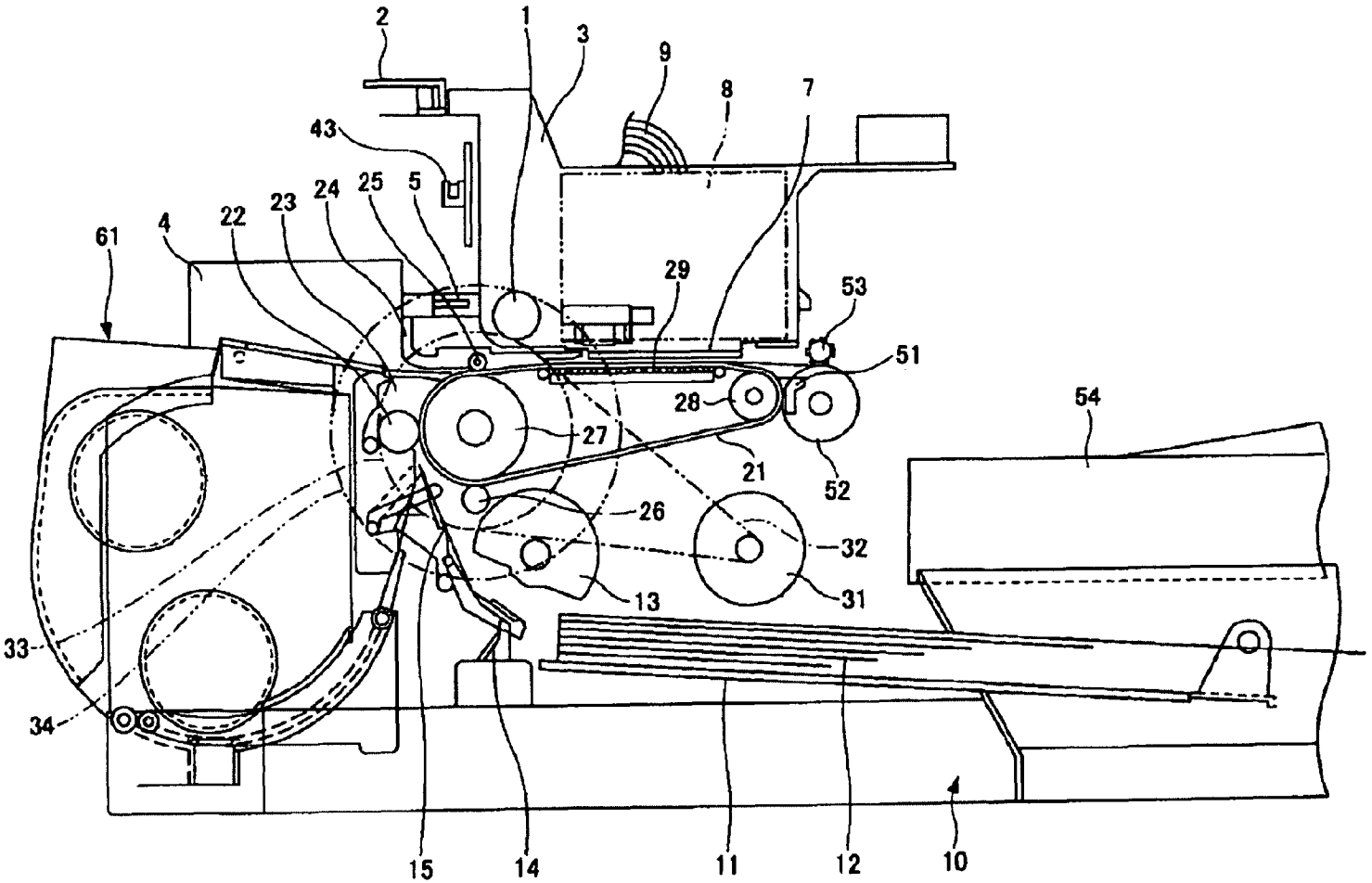
FIG. 1 is a side view illustrating a configuration of a mechanism portion of an image forming apparatus according to an embodiment of the present invention.
Figure 2:
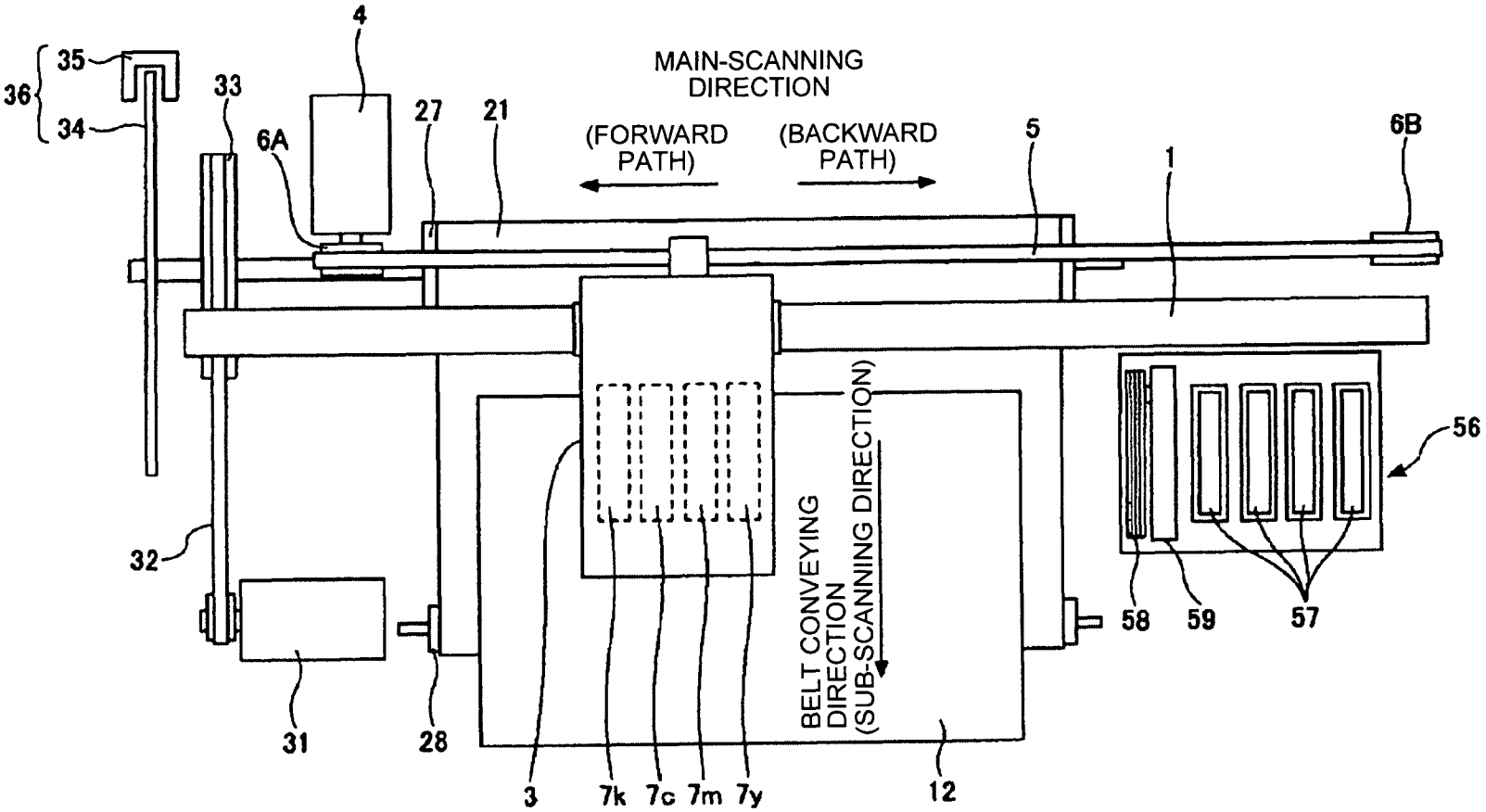
FIG. 2 is a plan view illustrating the configuration of the mechanism portion of the image forming apparatus according to the embodiment of the present invention.

FIG. 1 is a side view illustrating a configuration of a mechanism portion of an image forming apparatus according to an embodiment of the present invention, and FIG. 2 is a plan view of the mechanism portion.

Figure 11:
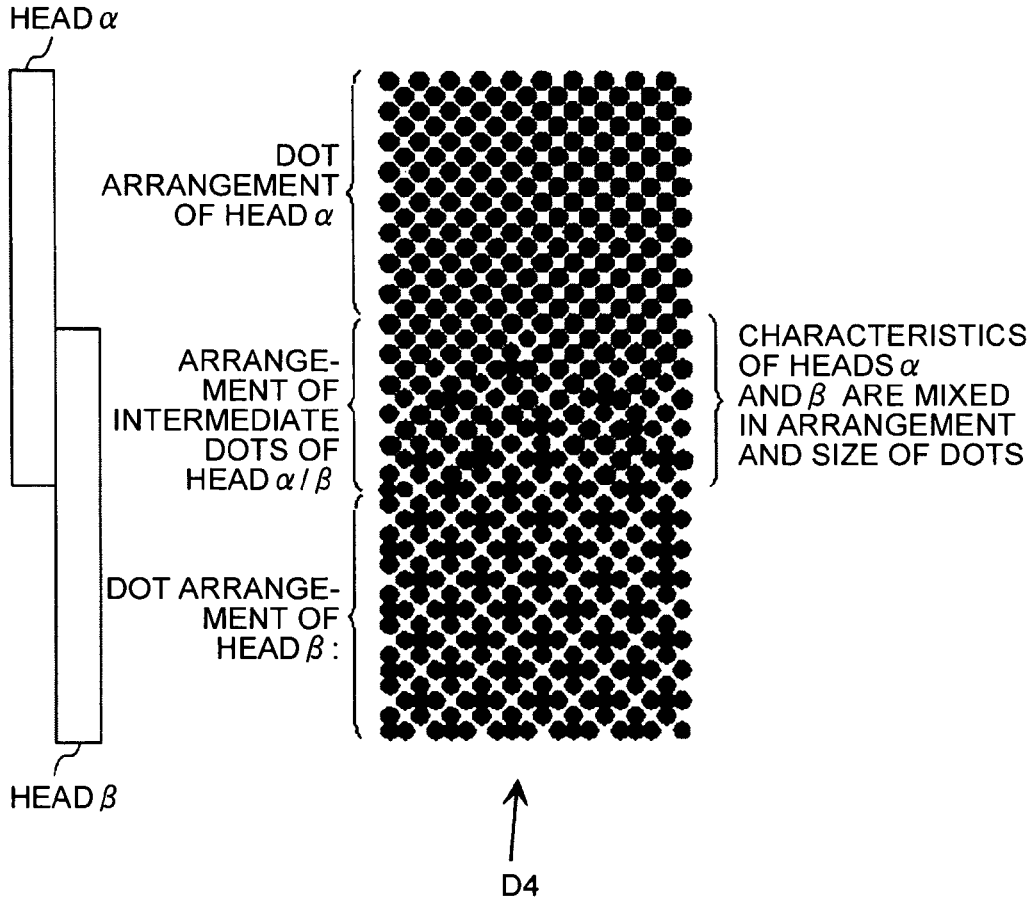
FIG. 11 is a diagram illustrating an example of a joint head of an image forming apparatus according to an embodiment of the present invention and a dot pattern thereof.

The image forming apparatus of this embodiment supports a carriage 3 in such a manner that the carriage 3 can slide in the main-scanning direction by using a guide rod 1 which is a guiding member laterally laid across left and right side plates not illustrated in the figure and a guide rail 2, and carriage 3, as a recording (print) head scanning unit, moves and scans in the direction (the main-scanning direction) shown as an arrow in FIG. 2 through a timing belt 5 that is stretched out between a driving pulley 6A and a driven pulley 6B by a main scanning motor 4. In the carriage 3, a plurality of sets of four-color recording (print) heads 7*y*, 7*c*, 7*m*, and 7*k* (referred to as a "recording head 7" when the color does not need to be identified) configured by liquid discharging heads that discharge ink droplets, for example, of yellow (Y), cyan (C), magenta (M), and black (K) is arranged in a nozzle row direction (here, a sub-scanning direction) with end portions thereof overlapping each other as illustrated in FIG. 11 described later.

In addition, a plurality of ink discharging ports is arranged in a direction intersecting the main scanning direction, and the plurality of ink discharging ports are provided so that the ink droplet discharging direction is set toward the lower side. In the carriage 3, sub tanks 8 of each color for supplying ink of each color to the recording head 7 are mounted. Ink is supplemented and supplied to the sub tank 8 from a main tank (ink cartridge) not illustrated in the figure through an ink supplying tube(s) 9.

As the liquid discharging head configuring the recording head 7, a liquid discharging head that includes a piezoelectric actuator such as a piezoelectric element, a thermal actuator that uses a phase change due to film boiling of liquid by using an electrical-to-thermal conversion element such as a heat element, a shape memory alloy actuator that uses a metal phase change according to a temperature change, an electrostatic actuator using an electrostatic force, or the like as a pressure generating unit which generates pressure used for discharging liquid droplets may be used. In addition, it is not limited to a configuration in which heads are independent for each color, but also it may be configured by one or a plurality of head members (liquid discharging heads) each including a nozzle row configured by a plurality of nozzles discharging ink droplets of a plurality of colors.

In addition, in the image forming apparatus of this embodiment, in a case where printing data is distributed, based on the printing data, there are a case where the data is distributed to each nozzle corresponding to the generation of a printing dot, and a case where, in a printing method in which a plurality of scanning operations is performed, the data is divided for each scanning operation and distributed.

Meanwhile, as a paper feeding unit used for feeding a paper sheet 12 loaded on a paper loading unit (pressurizing plate) 11 such as a paper feeding cassette 10, a semicircular roller (paper feeding roller) 13 that separates and feeds each paper sheet 12 from the paper loading unit 11 and a separation pad 14 that is opposing the paper feeding roller 13 and is formed from a material having a high coefficient of friction are included, and the separation pad 14 is biased to the paper feeding roller 13 side.

In addition, as a conveying unit used for conveying the paper sheet 12 fed from the paper feeding unit to the lower side of the recording head 7, a conveying belt 21 that is used for conveying the paper sheet 12 through electrostatic adsorption, a counter roller 22 that is used for conveying the paper sheet 12, which is sent from the paper feeding unit through a guide 15, with being nipped between the conveying belt 21 and the counter roller 22, a conveying guide 23 that is used for turning the paper sheet 12 sent approximately vertically upward by approximate 90 degrees so as to follow the conveying belt 21, and a pressurizing roller 25 that is biased to the conveying belt 21 side by a pressurizing member 24 are included. Furthermore, a roller charging device 26 that is used for charging the surface of the conveying belt 21 is included. Here, the conveying belt 21 is an endless belt, hangs so as to pass between a carriage roller 27 and a tension roller 28, and is configured so as to rotate in the belt conveying direction (the sub-scanning direction) illustrated in FIG. 2 by rotating the carriage roller 27 through a timing belt 32 and a timing roller 33 by using a sub-scanning motor 31. In addition, on the rear face side of the conveying belt 21, a guiding member 29 is arranged in correspondence with an image forming area of the recording head 7. Furthermore, the roller charging device 26 is brought into contact with the surface layer of the conveying belt 21 and is arranged so as to be driven to revolve in accordance with the rotation of the conveying belt 21.

In addition, as illustrated in FIG. 2, at the shaft of the carriage roller 27, a slit circular plate 34 is fixed, a sensor 35 that detects the slit of the slit circular plate 34 is disposed, and a rotary encoder 36 is configured by the slit circular plate 34 and the sensor 35.

Furthermore, as a discharging unit used for discharging the paper sheet 12 that has been recorded by the recording head 7, a separation claw 51 that is used for separating the paper sheet 12 from the conveying belt 21, an ejecting roller 52, a discharging roller 53, and a discharge tray 54 that stocks the discharged paper sheet 12 are included.

In addition, a duplex paper feeding unit 61 is detachably attached to the image forming apparatus. This duplex paper feeding unit 61 fetches the paper sheet 12 that is returned in accordance with the rotation of the conveying belt 21 in the reverse direction, then reverses the paper sheet 12, and feeds the paper sheet 12 again between the counter roller 22 and the conveying belt 21. In addition, as illustrated in FIG. 2, in a non-printing area located on one side in the scanning direction of the carriage 3, a maintenance and recovery mechanism 56 that is used for maintaining and recovering the nozzle state of the recording head 7 is disposed.

This maintenance and recovery mechanism 56 includes: caps 57 that are used for capping each nozzle face of the recording head 7; a wiper blade 58 that is a blade member used for wiping the nozzle faces; an idle discharging receiver 59 that receives ink droplets when idle discharging for discharging liquid droplets not contributing to recording is performed so as to discharge recording liquid which has an increased viscosity; and the like.

In the image forming apparatus configured as described above, paper sheets 12 are separated and fed one sheet at a time from the paper feeding unit, a paper sheet 12 fed approximately vertically upward is guided by the guide 15, is conveyed while being nipped between the conveying belt 21 and the counter roller 22, and the leading edge thereof is further guided by the conveying guide 23 and is pressed onto the conveying belt 21 by the pressurizing roller 25, and the conveying direction thereof is turned by about 90 degrees. At this time, by applying an alternating current (AC) voltage in which the positive polarity and the negative polarity alternately repeats to the roller charging device 26 from an AC bias supplying unit 212 (FIG. 3) to be described later, the conveying belt 21 is charged in a charged AC voltage pattern, that is, in a pattern in which the positive polarity and the negative polarity alternately repeat with a predetermined width in the sub scanning direction that is the revolving direction. When the paper sheet 12 is conveyed on the charged conveying belt 21, the paper sheet 12 is electrostatically adsorbed onto the conveying belt 21, and the paper sheet 12 is conveyed in the sub-scanning direction in accordance with the revolving movement of the conveying belt 21.

Thus, by driving the recording head 7 in accordance with an image signal while moving the carriage 3 in the direction of the forward path and the direction of the backward path, ink droplets are discharged onto the paper sheet 12 in a stopped state so as to record one line, then after the paper sheet 12 is conveyed by a predetermined amount, the next line is recorded thereon. By receiving a recording end signal or a signal indicating that the trailing edge of the paper sheet 12 arrives at the recording area, the recording operation ends, and the paper sheet 12 is discharged to a discharge tray 54.

In addition, in the case of duplex printing, by reversely rotating the conveying belt 21 when the recording of the front face (a face that is printed first) ends, the paper sheet 12 for which recording has been completed is sent to a duplex paper feeding unit 61, the paper sheet 12 is reversed (a state is formed in which the rear face is to be a printing face) and is fed again between the counter roller 22 and the conveying belt 21, and the paper sheet 12 is conveyed on the conveying belt 21, as described above, by performing timing control, and after recording is performed for the rear face, the paper sheet 12 is discharged to the discharge tray 54.

In addition, while the printer is in print (recording) standby, the carriage 3 is moved to the maintenance and recovery mechanism 56 side, and the nozzle face of the recording head 7 is capped by the cap 57, and accordingly, the nozzles are maintained in a moist state, whereby a discharge defect due to dry ink is prevented. In addition, recording liquid is suctioned from the nozzles in the state in which the recording head 7 is capped by the cap 57, and a recovery operation of discharging recording liquid having increased viscosity or air bubbles is performed, and, in order to clean and remove ink attached to the nozzle face of the recording head 7 through the recovery operation, wiping is performed by using the wiper blade 58. In addition, before starting a recording, during recording, or the like, an idle discharge operation of discharging ink not relating to recording is performed. Accordingly, a stable discharging performance of the recording head 7 is maintained.

Electrical Configuration of Image Forming Apparatus

Next, the electrical configuration of the image forming apparatus will be described with reference to a block diagram illustrated in FIG. 3. This image forming apparatus includes a printing control section 200, and the printing control section 200 includes: a central processing unit (CPU) 201 that controls the overall operation of the apparatus; a read only memory (ROM) 202 that stores a program executed by the CPU 201 and other fixed data therein; a random access memory (RAM) 203 that temporarily stores image data or the like therein; a non-volatile RAM (NVRAM) 204 that can rewrite data for maintaining the data even while the power source of the apparatus is cut off; and an application specific integrated circuit (ASIC) 205 that performs various signal processing of image data, image processing such as reordering, and input/output signal processing for controlling the overall operation of the apparatus.

In addition, the image forming apparatus includes a head driver (driver IC, driver integrated circuit) 208 that is used for driving the recording head 7 disposed on the carriage 3 side.

Furthermore, the printing control section 200 includes: a host interface (I/F) 206 that is used for transmitting or receiving data or a signal to or from the host side; a printing control unit 207 that includes a data transmission unit used for controlling the driving of the recording head 7 and a driving waveform generating unit generating a driving waveform; a motor driving unit 210 that is used to drive the main scanning motor 4 and the sub-scanning motor 31; an AC bias supplying unit 212 that supplies an AC bias to the roller charging device 26; and an input/output (I/O) 213 that is used to receive each of detection signals transmitted from an encoder sensor 43 and the encoder sensors 35 and detection signals transmitted from various other sensors such as a temperature sensor 215 which detects the environmental temperature; and the like.

In addition, an operational panel 214 that is used for inputting and displaying information necessary for the image forming apparatus is connected to the printing control section 200.

Here, the printing control section 200 receives image data and the like transmitted from the host side including an information processing apparatus such as a personal computer, an image reading apparatus such as an image scanner, an imaging apparatus such as a digital camera, and the like through a cable or a network by using the host I/F 206. Then, the CPU 201 of the printing control section 200 reads out and analyzes image data stored in a reception buffer included in the host I/F 206, then performs necessary image processing, a data reordering process, and the like in the ASIC 205, and transmits the printing data which has passed through the processing, from the printing control unit 207 to a head driver 208. In addition, the generation of the recording dot pattern data (printing data) for outputting an image may be performed by a printer driver disposed on the host side as will be described later.

The printing control unit 207 transmits the above-described printing data to the head driver 208 as serial data and outputs a transmission clock and/or a latch signal that are necessary for the transmission of the printing data, the determination of the transmission, and the like, a droplet control signal (mask signal), and the like, the determination of the transmission, and the like to the head driver 208. In addition, the printing control unit 207 includes a driving waveform generating unit that is configured by an D/A converter that converts the pattern data of a driving signal stored in the ROM 202 from digital to analog, a voltage amplifier, a current amplifier, and the like, and a driving waveform selection unit that selects a driving waveform to be given to the head driver 208, and generates the driving waveform which is configured by one driving pulse (driving signal) or a plurality of driving pulses (driving signals), then outputs the generated driving waveform to the head driver 208.

The head driver 208 drives the recording head 7 by applying a driving signal, the driving signal configuring the driving waveform given from the printing control unit 207 based on the printing data corresponding to one line of the recording head 7 which is input as serial data, to a driving element (for example, the piezoelectric element as described above) that generates energy used for selectively discharging a liquid droplet of the recording head 7. At this time, by selecting a driving pulse that configures the driving waveform, dots having different sizes such as a large droplet (large dot), a medium droplet (medium dot), a small droplet (small dot) may be selectively shot out.

In addition, the CPU 201 calculates a driving output value (control value) for the main scanning motor 4, based on a speed detection value and a position detection value that are acquired by sampling a detection pulse transmitted from the encoder sensor 43 that configures the linear encoder, and a speed target value and a position target value that are acquired from a speed/position profile stored in advance, and then drives the main scanning motor 4 through the motor driving unit 210. Similarly, the CPU 201 calculates a driving output value (control value) for the sub-scanning motor 31, based on a speed detection value and a position detection value that are acquired by sampling a detection pulse transmitted from the encoder sensor 35 which configures the rotary encoder 36 and a speed target value and a position target value that are acquired from a speed/position profile stored in advance, and then drives the sub-scanning motor 31 through the motor driver which is driven by the motor driving unit 210.

Printing Control Unit and Head Driver

Figure 3:
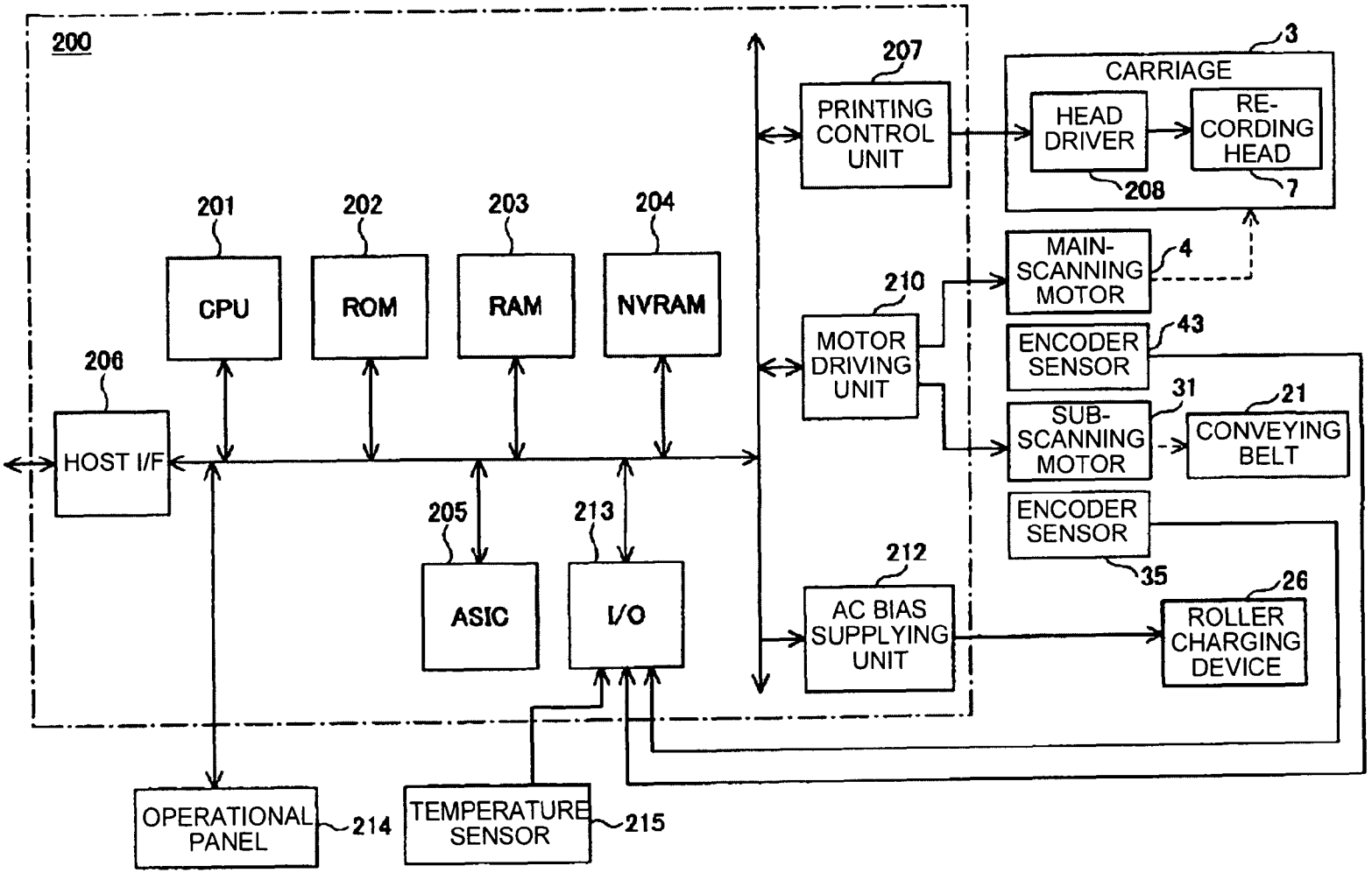
FIG. 3 is a block diagram illustrating an electrical configuration of the image forming apparatus according to the embodiment of the present invention.
Figure 4:
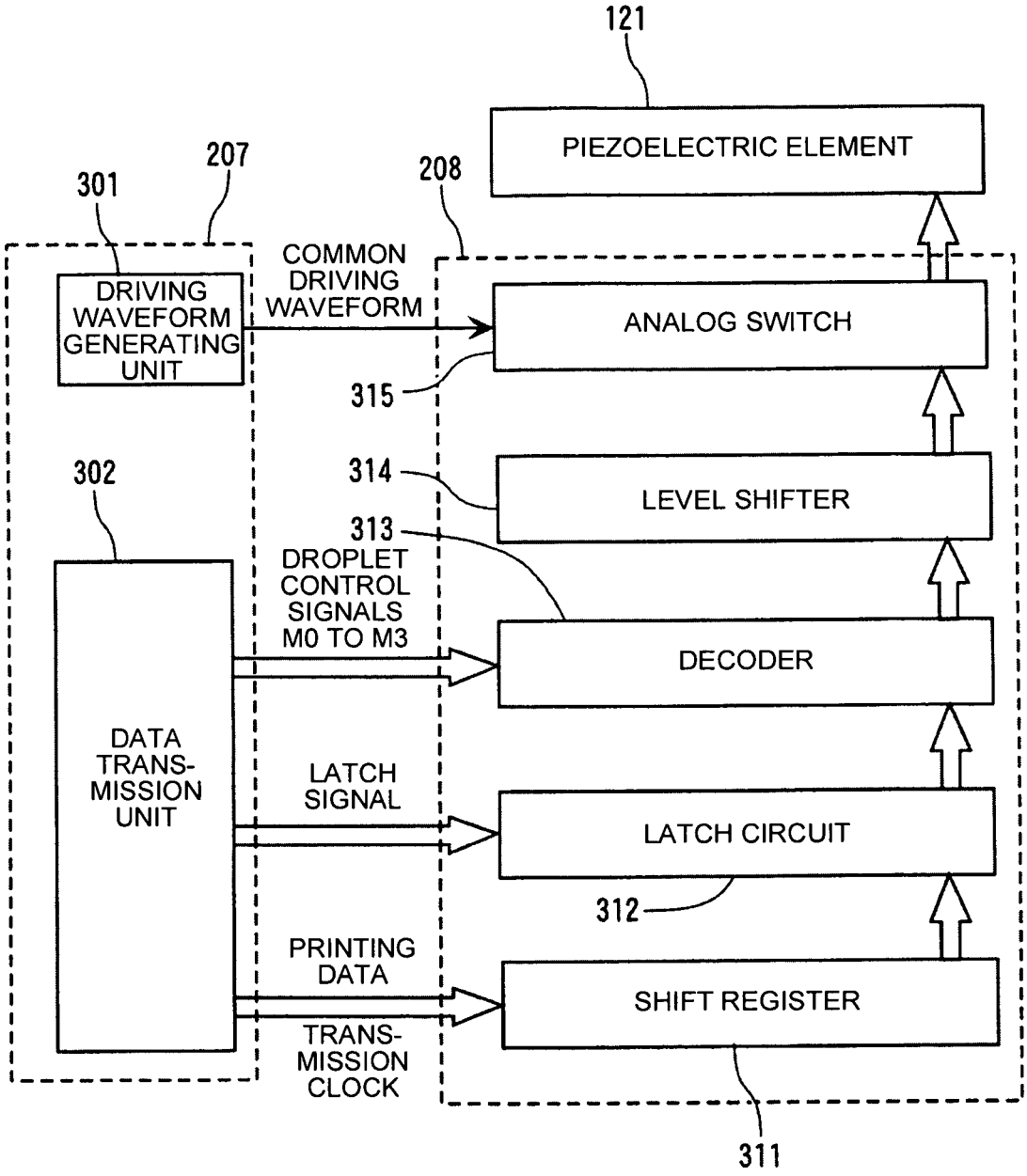
FIG. 4 is a block diagram illustrating an example of a printing control unit of a printing control section and a head driver shown in FIG. 3.

FIG. 4 is a block diagram illustrating an example of the printing control unit 207 and the head driver 208 shown in FIG. 3.

The printing control unit 207 includes a driving waveform generating unit 301 that generates and then outputs a driving waveform (common driving waveform) configured by a plurality of driving pulses (driving signals) within one printing period, and a data transmission unit 302 that outputs two-bit printing data (tone (gray scale, gradation) signal 0 or 1) according to a printing image, a clock signal, a latch signal, or droplet control signals M0 to M3. Here, the droplet control signal is a two-bit signal that instructs, for each droplet, the opening/closing of an analog switch 315 which is a switching unit described later of the head driver 208 and the state of the droplet control signal transits to a high level (On) in a waveform to be selected in accordance with a printing period of the common driving waveform and transits to a low level (Off) at the time of no selection.

The head driver 208 includes: a shift register 311 that receives a transmission clock (shift clock) and the serial printing data (tone data: two bits/CH) transmitted from the data transmission unit 302 as inputs; a latch circuit 312 that is used for latching the value of each register of the shift resister 311 in accordance with a latch signal; a decoder 313 that decodes the tone data and the droplet control signals M0 to M3 and outputs the decoded results; a level shifter 314 that shifts a logical level voltage signal of the decoder 313 to a level in which the analog switch 315 is operable; and an analog switch 315 that is turned on or off (closed or open) in accordance with the output of the decoder 313 that is given through the level shifter 314. This analog switch 315 is connected to a selection electrode (individual electrode) of each piezoelectric element 121, which is not illustrated in the figure, and receives the common driving waveform transmitted from the driving waveform generating unit 301 as an input. Accordingly, by turning on the analog switch 315 in accordance with the decoded results of the printing data (tone data) serially transmitted and the droplet control signals M0 to M3 by using the decoder 313, a necessary driving signal configuring the common driving waveform is allowed to pass (is selected) through the analog switch so as to be applied to the piezoelectric element 121.

Driving Waveform and Driving Signal

Next, the driving signal applied to the piezoelectric element 121 will be described with reference to FIGS. 5 to 6. Here, FIG. 5 is a diagram illustrating a common driving waveform generated by the driving waveform generating unit 301, FIG. 6 illustrates respective driving signals for a small droplet, a medium droplet, a large droplet, and a fine driving, which are selected by the analog switch 315 based on the driving waveform illustrated in FIG. 5.

Figure 5:
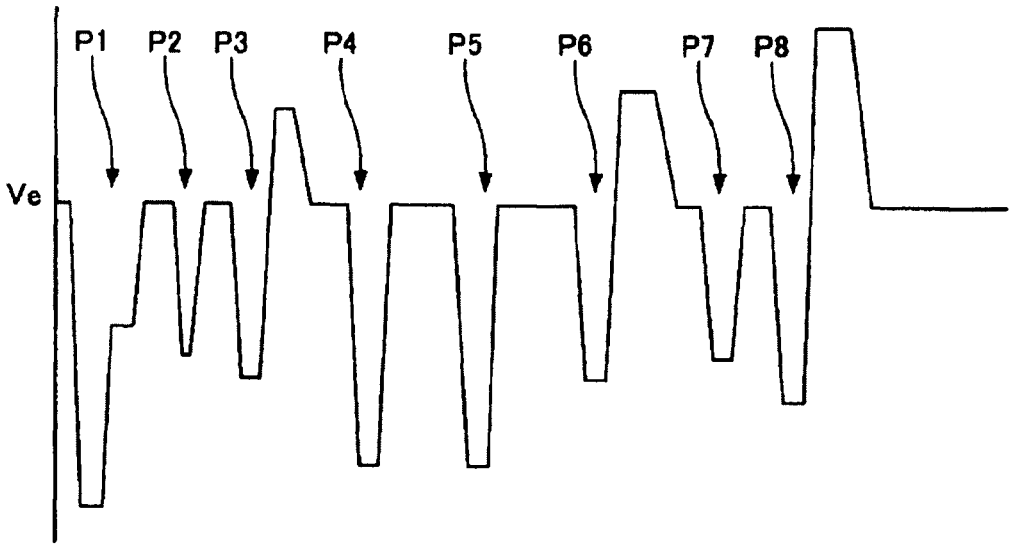
FIG. 5 is a diagram illustrating a driving waveform generated by a driving waveform generating unit of the printing control unit shown in FIG. 4.

The driving waveform generating unit 301 generates and outputs a driving waveform (driving signal) that is formed from eight driving pulses P1 to P8 which are configured by a waveform element falling from a reference electric potential Ve, a waveform element rising from a fallen state, and the like, as illustrated in FIG. 5, within one printing period (one driving period). A driving pulse to be used is selected in accordance with the droplet control signals M0 to M3 transmitted from the data transmission unit 302. Here, the waveform element in which the electric potential V of the driving pulse falls from the reference electric potential Ve is a pulling-in waveform element for which the piezoelectric element 121 is contracted so as to expand the volume of a pressurizing ink tank (not illustrated in the figure). In addition, the waveform element rising from the fallen state is a pressurizing waveform element for which the piezoelectric element 121 expands so as to contract the volume of the pressurizing ink chamber.

Figure 6:
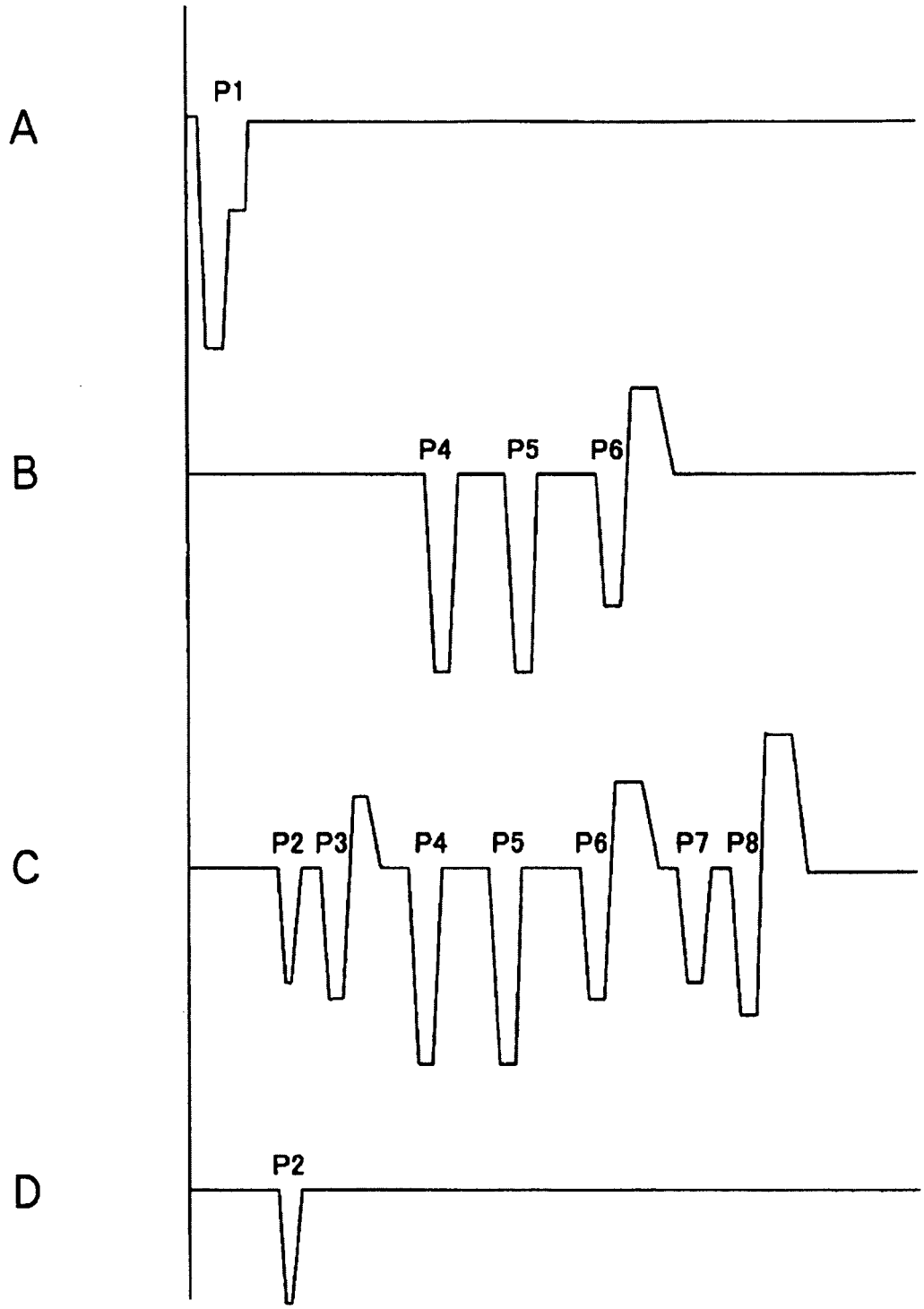
FIG. 6 is a diagram illustrating driving signals for a small droplet, a medium droplet, and a large droplet, and a fine driving which are selected based on the driving waveform illustrated in FIG. 5.

In a case where a small droplet (small dot) is formed in accordance with the droplet control signals M0 to M3 transmitted from the data transmission unit 302, as illustrated in Portion A of FIG. 6, the driving pulse P1 is selected, in a case where a medium droplet (medium dot) is formed, as illustrated in portion B of FIG. 6, the driving pulses P4 to P6 are selected, in a case where a large droplet (large dot) is formed, as illustrated in portion C of FIG. 6, the driving pulses P2 to P8 are selected, and, in a case of the fine driving (a meniscus is vibrated without accompanying droplet discharge), as illustrated in portion D of FIG. 6, the driving pulse P2 is selected. Then, the selected driving pulse is applied to the piezoelectric element 121 of the recording head 7.

By using the driving waveform that is configured by the above-described driving pulses, a time interval until each droplet of a large size, a medium size, or a small size lands on a paper sheet can be controlled, and accordingly, although the discharge start time is different for each droplet of the large size, the medium size, and the small size, each droplet can land at almost the same position.

Image Forming System

Figure 7:
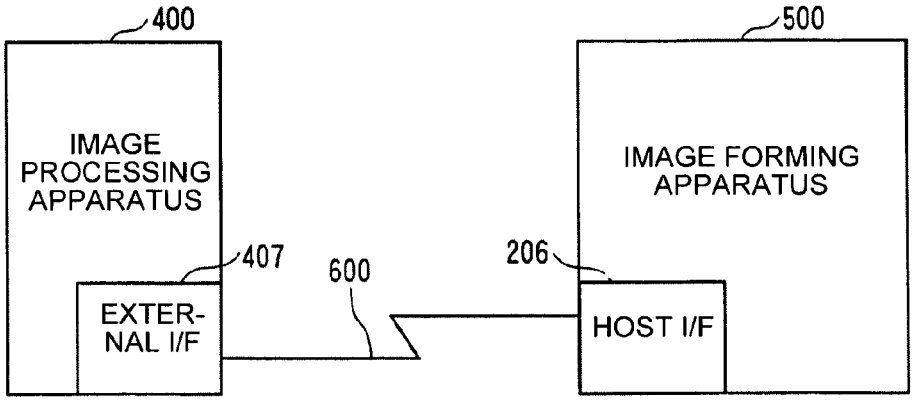
FIG. 7 is a diagram illustrating an image forming system that includes an image forming apparatus according to an embodiment of the present invention.

FIG. 7 is a diagram illustrating an image forming system that includes an image forming apparatus according to an embodiment of the present invention. This image forming system has a configuration in which an image forming apparatus 500 according to an embodiment of the present invention and an image processing apparatus 400 in which a program used for outputting a printing image by using the image forming apparatus 500 is mounted are interconnected through a network 600 or the like. The image processing apparatus 400 is configured by a personal computer (PC) or the like, and an external I/F 407 thereof and the host I/F 206 of the image forming apparatus 500 are interconnected through the network 600 or the like. Here, although one image processing apparatus 400 and one image forming apparatus 500 are disposed, a plurality of the image processing apparatus 400 and a plurality of the image forming apparatus 500 may be disposed.

Image Processing Apparatus

Figure 8:
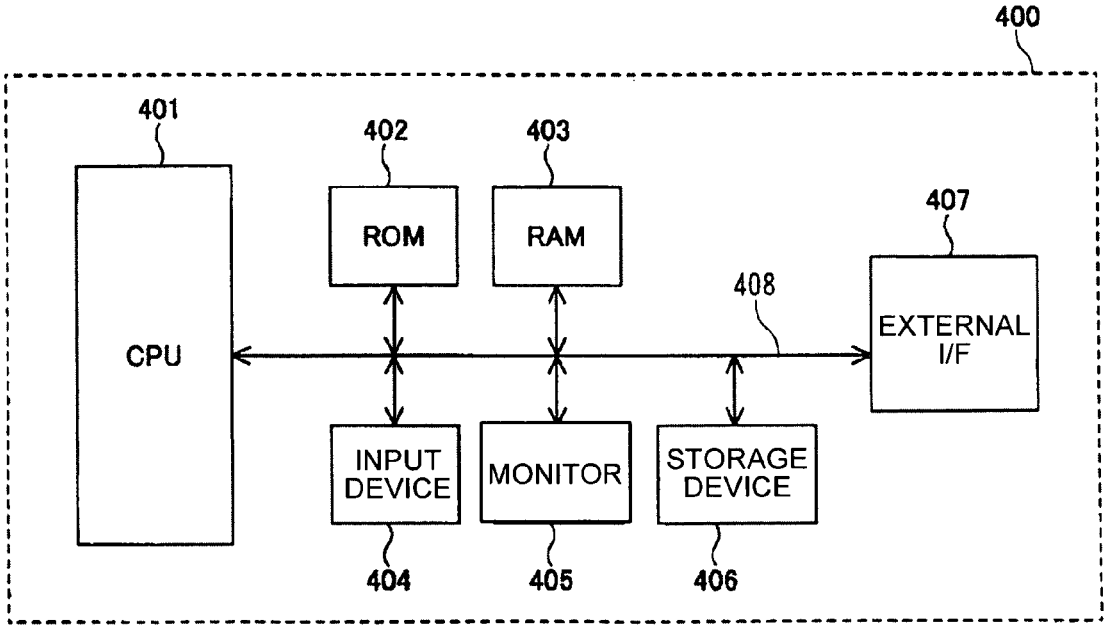
FIG. 8 is a block diagram of an image processing apparatus shown in FIG. 7.

FIG. 8 is a block diagram of the image processing apparatus 400.

In the image processing apparatus 400, a CPU 401, a ROM 402 and a RAM 403 as various memory units are interconnected through a bus line 408. An input device 404 such as a mouse, a keyboard, or the like, a monitor 405 such as a liquid crystal display (LCD) or a CRT, and a storage device 406 such as a magnetic storage device such as a hard disk, and an external I/F 407 that communicates with an external device such as a USB or communicates with a network such as the Internet, are connected to the bus line 408 through a predetermined I/F not illustrated in the figure. In addition, a storage medium reading device that reads out data from a storage medium such as an optical disc that is not illustrated in the figure is connected thereto.

In the storage device 406, an image processing program is stored. This image processing program is read out by the storage medium reading device from a storage medium such as an optical disc or is downloaded from a network such as the Internet via the external I/F 407, and is installed to the storage device 406. Through such installation, the image processing apparatus 400 is in a state of being able to perform image processing (to be described later in detail). In addition, the image processing program may be operated on a predetermined operating system. Furthermore, the image processing process may form a part of specific application software.

In addition, although image processing according to this embodiment may be performed on the image forming apparatus 500 side, here, an example will be described in which the image forming apparatus 500 side receives an image drawing command or a text printing command therein and does not have a function of actually generating the recording dot pattern data. In other words, an example will be described in which image processing is performed, for a print command from application software executed by the image processing apparatus 400 serving as a host, by a printer driver according to the present invention that is built in the image processing apparatus 400 (host computer) as software, multi-value recording dot pattern data that can be output by the image forming apparatus 500 is generated, the recording dot pattern data is rasterized and is transmitted to the image forming apparatus 500, and the image forming apparatus 500 prints the received data so as to be output.

Described in more detail, inside the image processing apparatus 400, an image drawing command or a text recording (printing) command (for example, a command in which the position, the thickness, the shape, and the like of a line to be recorded are defined or a command in which the font type, the size, the position, and the like of a text to be recorded are defined) transmitted from the application software or the operating system are temporarily stored, for example, in the RAM 403. Such a command is described in a specific printing language.

Then, the command stored in the RAM 403 is analyzed by a rasterizer, in a case where the command is a line recording command, the command is converted into recording dot pattern data corresponding to the position, the thickness, and the like that have been designated, in a case where the command is a text recording command, outline information of a text corresponding to font outline data stored inside the image processing apparatus (host computer) 400 is called and is converted into recording dot pattern data corresponding to the position and the size that have been designated, and, in the case of image data, the data is directly converted into recording dot pattern data.

Thereafter, image processing is performed for the recording dot pattern data and is stored, for example, in the RAM 403. At this time, the image processing apparatus 400 rasterizes the recording dot pattern data by setting an orthogonal grid as the basic recording position. As the image processing, for example, color management processing (CMM) for adjusting the colors, γ correction processing, halftone processing such as a dithering method or an error diffusion method, background elimination processing, ink total volume control processing, and the like may be performed.

Then, the recording dot pattern data stored in the RAM 403 is transmitted to the image forming apparatus 500 through the external I/F 407 and the host I/F 206. Also on the image forming apparatus 500 side, image processing such as halftone processing may be performed for the above-described recording dot pattern data. In such a case, the printing control unit 207 performs the above-described processing for the image data so as to generate the recording dot pattern data for which the halftone processing and the like have been performed.

Functional Block of Imaging Forming Apparatus

In the image forming apparatus of this embodiment, as a recording method, so-called a one-pass printing may be used in which an image is formed on a paper sheet by performing main scanning once or so-called a multi-pass printing may be used in which an image is formed for the same area of a paper sheet by performing main scanning a plurality of times by using the same nozzle group or different nozzle groups. In addition, it may be configured such that the heads are aligned in the main scanning direction, and the same area is selectively shot out by different nozzles. Such recording methods may be used by appropriately combining the recording methods.

Figure 9:
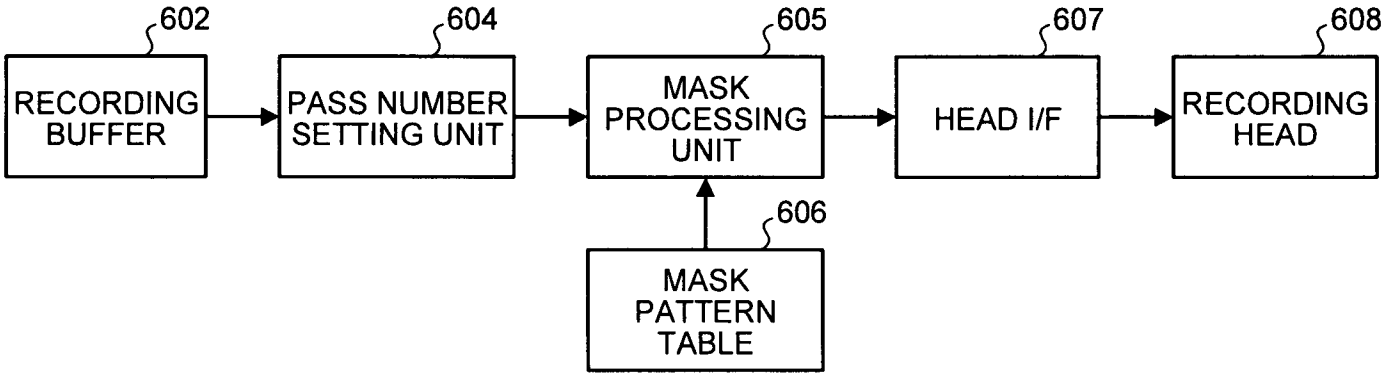
FIG. 9 is a block diagram illustrating an example of a function of the image forming apparatus according to an embodiment of the present invention.

Here, the multi-pass printing will be described. FIG. 9 is a block diagram illustrating an example of a function of the image forming apparatus according to this embodiment. As illustrated in the figure, the image forming apparatus of this embodiment includes: a recording buffer 602; a pass number setting unit 604; a mask processing unit 605; a mask pattern table 606; a head I/F unit 607; and a recording head 608.

Bit map data (printing data) transmitted from the image processing apparatus 400 is stored at a predetermined address in the recording buffer 602 by a recording buffer control unit not illustrated in the figure. The recording buffer 602 has a capacity for storing the bit map data corresponding to the amount of paper conveyance and one scan, and configures a ring buffer in units of paper conveyance amounts such as a FIFO memory.

When the bit map data corresponding to one scan is stored in the recording buffer 602, the recording buffer control unit controls the recording buffer 602 so as to start the printer engine, reads out bit map data from the recording buffer 602 in accordance with the position of each nozzle of the recording head and inputs the bit map data to the pass number setting unit 604. In addition, when the bit map data of the next scan is input from an input terminal not illustrated in the figure, the recording buffer control unit controls the recording buffer 602 so as to store the bit map data in a vacant area (an area corresponding to the paper conveyance amount for which recording has been completed) of the recording buffer 602.

The pass number setting unit 604 determines the number of divided passes and outputs the number of passes to the mask processing unit 605. In the mask pattern table (this may be briefly referred to as a mask pattern) 606, a necessary mask pattern is selected from mask patterns stored in advance, for example, mask patterns for one-pass recording, two-pass recording, four-pass recording, and eight-pass recording in accordance with the number of divided passes used for determining a necessary mask pattern and outputs the selected mask pattern to the mask processing unit 605. When the mask processing unit 605 masks the bit map data stored in the recording buffer 602 for each pass recording by using the mask pattern and outputs the masked bit map data to the head driver 208, the head driver 208 reorders the masked bit map data into the order that the data is used by the recording head 608 and transmits resultant bit map data to the recording head 608.

Here, the recording buffer 602, for example, is realized by the RAM 203, and the mask pattern table 606, for example, is stored in the ROM 202. The pass number setting unit 604 and the mask processing unit 605 may be realized by any one of the printing control unit 207, a combination of the printing control unit 207 and the CPU 201, and the CPU 201. The recording buffer control unit may be realized by the CPU 201.

By using the multi-pass printing as above, banding that is visually noticeable in the one-pass printing can be averaged so as not to be visually noticeable. However, since the number of scans of a paper sheet increases in correspondence with the number of passes, the disadvantage is that the productivity decreases to about "1/number of passes" times that of the one-pass printing.

Overlap Processing

In the image forming apparatus of this embodiment, a plurality of heads is connected to lengthen the nozzle row, and accordingly, the width that can be printed through one scan is wider so the productivity is very high. In addition, in order to prevent the generation of an image stripe in the joint of heads due to misalignment of heads in the assembly, or the generation of color unevenness at the head pitch due to a difference in the discharge characteristic that is caused by non-uniformity of heads or driving circuits occurring in the manufacturing process, parts of nozzles overlap each other so as to arrange an overlapping area (overlapping portion), and the printing data is distributed to the overlapped nozzles (hereinafter, referred to as overlapping nozzles), whereby a difference in the local density of dots is dispersed.

The overlapping area represents an area in which there is a plurality of nozzles corresponding to generation of one dot, and more particularly, an overlapping area is formed in the joints of a plurality of recording heads or an overlapping area is formed by discharging an ink droplet to one dot a plurality of times by scanning a recording head.

Figure 14:
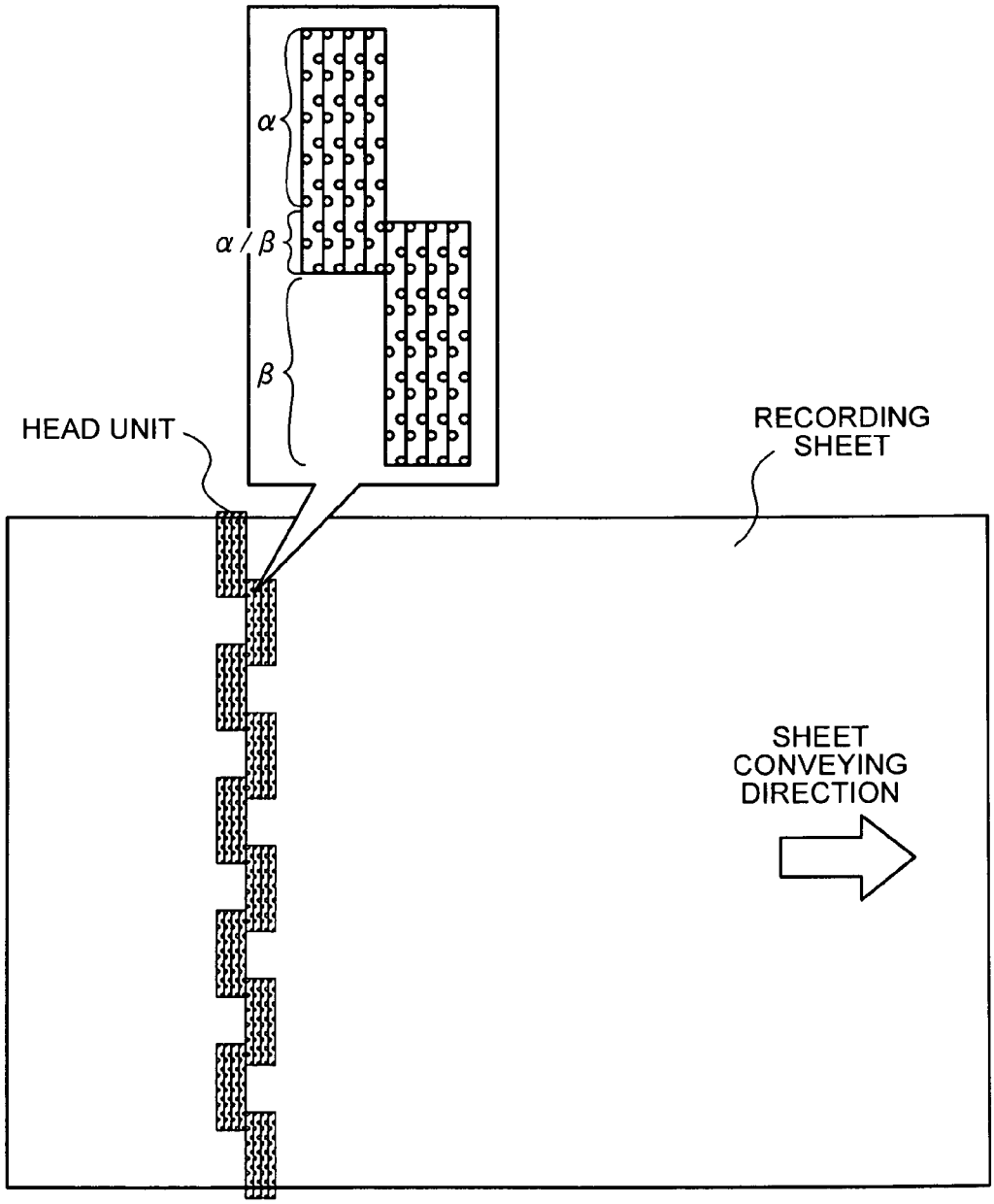
FIG. 14 is a diagram illustrating another example of a joint head of an image forming apparatus according to an embodiment of the present invention.
Figure 15:
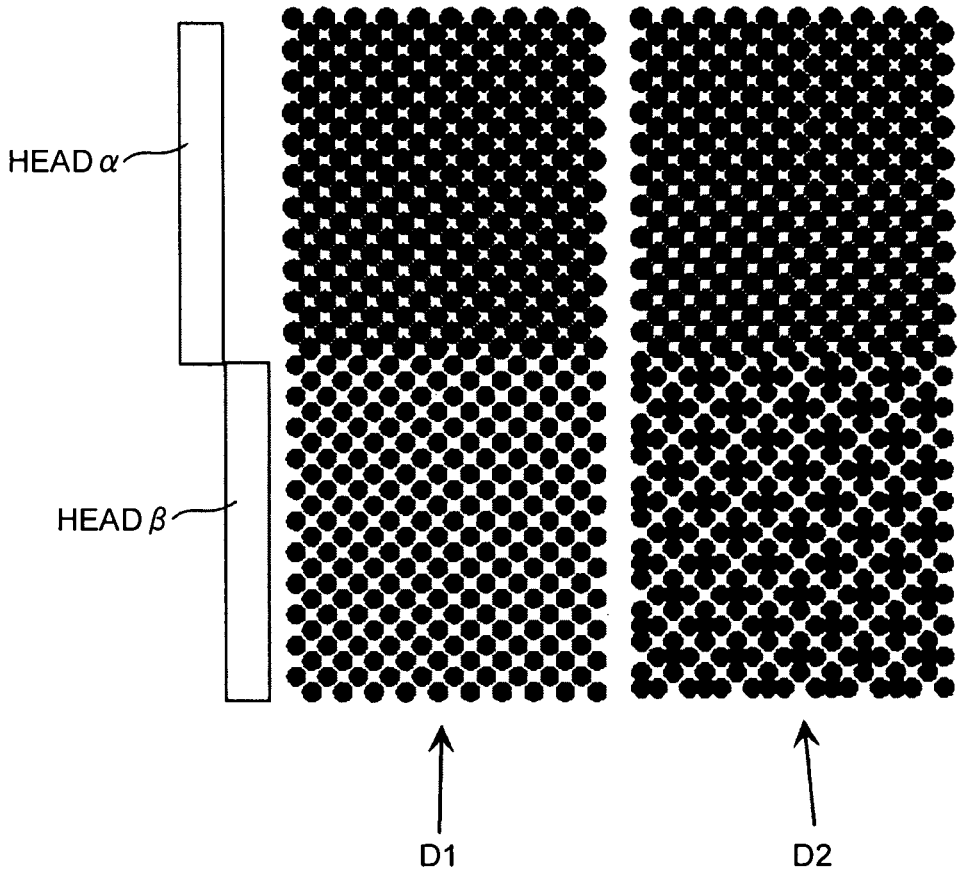
FIG. 15 is a diagram illustrating a dot pattern of dots formed by a joint head in a case where tone correction is performed in units of heads.
Figure 16:
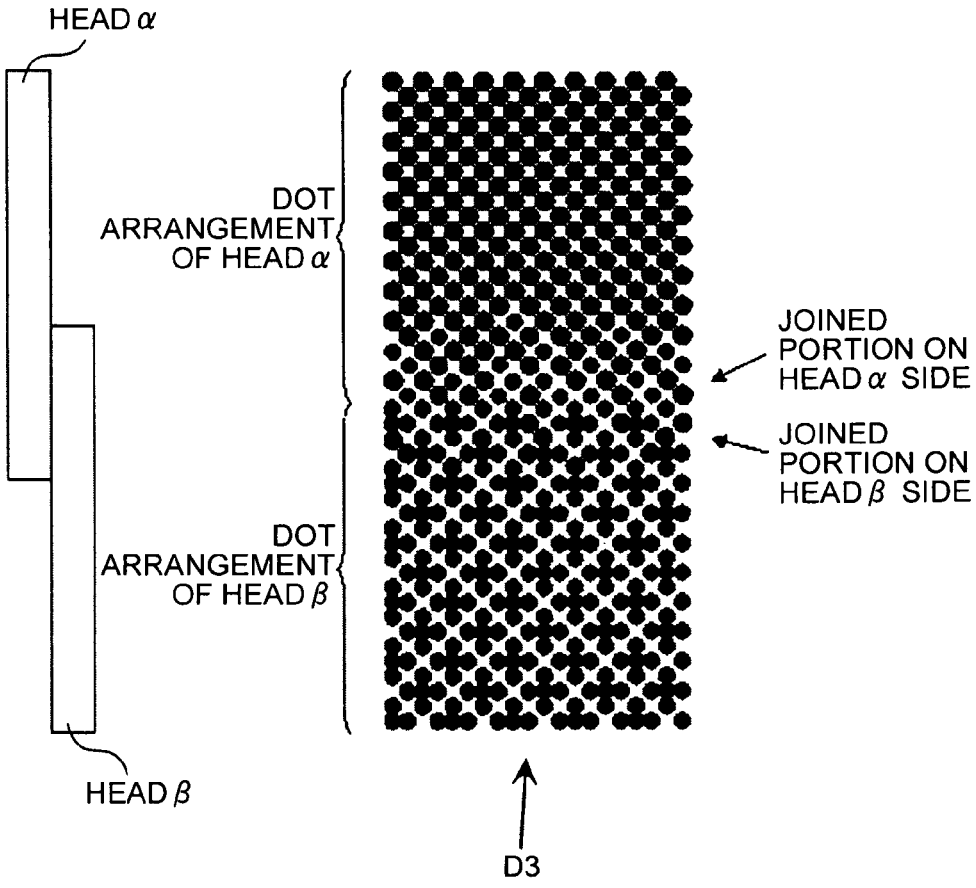
FIG. 16 is a diagram illustrating a dot pattern of dots formed by a joint head in a case where tone correction in units of heads and an overlapping process for an overlapping portion are performed together.

In this embodiment, recording heads each having a plurality of nozzles in a predetermined direction are used, and an image is formed by a recording head in which at least two recording heads overlap each other for a predetermined number of nozzles in a predetermined direction. The predetermined direction is the sub-scanning direction in the case of a serial-type head (FIGS. 10 and 11 to be described later) and is a direction perpendicular to the paper conveying direction in the case of a line-type head (FIG. 14 to be described later). The predetermined direction is the same as the nozzle row direction.

In the overlapping area, since there are at least two nozzles corresponding to one dot in the data, when no special treatment is arranged, one dot in the data is shot out by two nozzles. Accordingly, the color is thick in the overlapping area, and the problem of banding is generated.

Thus, in this embodiment, by distributing the printing data of the overlapping area of two heads adjacent to each other to the overlapping nozzles of both heads, the amount of ink that is originally targeted can be discharged. In this process of the overlapping area, it is preferable that the dot data after quantization is distributed to the overlapping nozzles on both sides.

Figure 10:
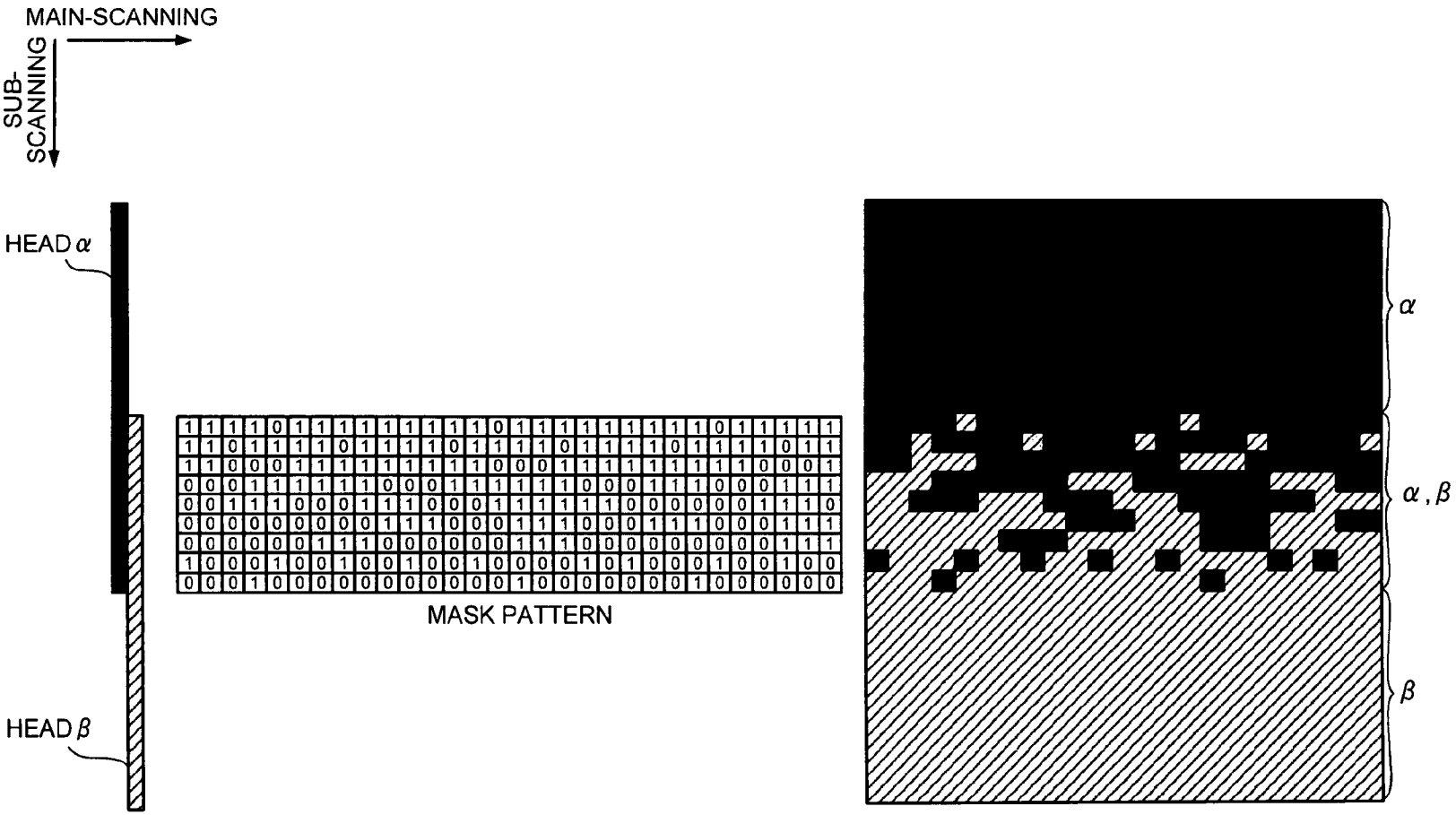
FIG. 10 is a diagram illustrating an example of a mask pattern that is used in an overlapping process for an overlapping portion of joint heads of an image forming apparatus according to the present embodiment.

As a mean that distributes the dots of the overlapping portion to the overlapping nozzles, as illustrated in FIG. 10, a mask pattern that assigns discharge/no-discharge may be used. FIG. 10 is a diagram illustrating an example in which end portions of serial-type heads α and β overlap each other, and data of the overlapping portion is assigned to nozzles of the head α and nozzles of the head β by using a mask pattern. In the figure, "1" represents discharge, and "0" represents no-discharge, and, in the overlapping area, inverse patterns are assigned to the nozzles of the two heads. Accordingly, the dots of the overlapping area can be exclusively assigned to the overlapping nozzles.

The mask pattern used for determining discharge/no-discharge of the dots of the overlapping area is held, for example, in the ROM 202. The printing control unit 207 may distribute the formation of dots to the overlapping nozzles by applying the mask pattern to the data corresponding to the nozzle positions.

The mask pattern may be a uniform pattern or a pattern, as illustrated in FIG. 10, in which the number of dots responsible for the formation differs in accordance with the position of the overlapping nozzle (in this example, as the position of the overlapping nozzle is closer to the end portion, the number of dots responsible for the formation decreases). In any case, the dot distributing process may be performed by generating a desired mask pattern in advance and applying the mask pattern to the printing data corresponding to the nozzle position.

Color Unevenness Correcting Process

Next, the correction of color unevenness of the head characteristic will be described. The color unevenness described here represents the occurrence of a color difference between heads due to fluctuations of the heads or the driving circuits or the like. Here, as the correction, the input/output characteristics of the joint head are corrected through γ correction, thereby decreasing a difference in the tinge.

As described above, a method of decreasing the tinge by correcting the input/output characteristics of joined heads through γ correction is known, as is disclosed in Japanese Patent Application Laid-open No. 2009-234115. However, in this embodiment, the above-described overlapping process and the correction process of the input/output characteristics of the joint head are performed together. However, only by performing the overlapping process and the correction process of the input/output characteristics of the joint head together, as described above, the overlapping portion is formed to be thin or thick, and, as a result, there is a case where a density stripe is generated in the overlapping portion.

Thus, in this embodiment, when the correction of the input/output characteristics is performed, for the overlapping portion, after the dot arrangement is approached by using an intermediate characteristic of the joined heads, the overlapping process is performed, and accordingly, the γ correction and the overlapping process are balanced, whereby an excellent image having no color unevenness and no stripe is formed.

Figure 12:
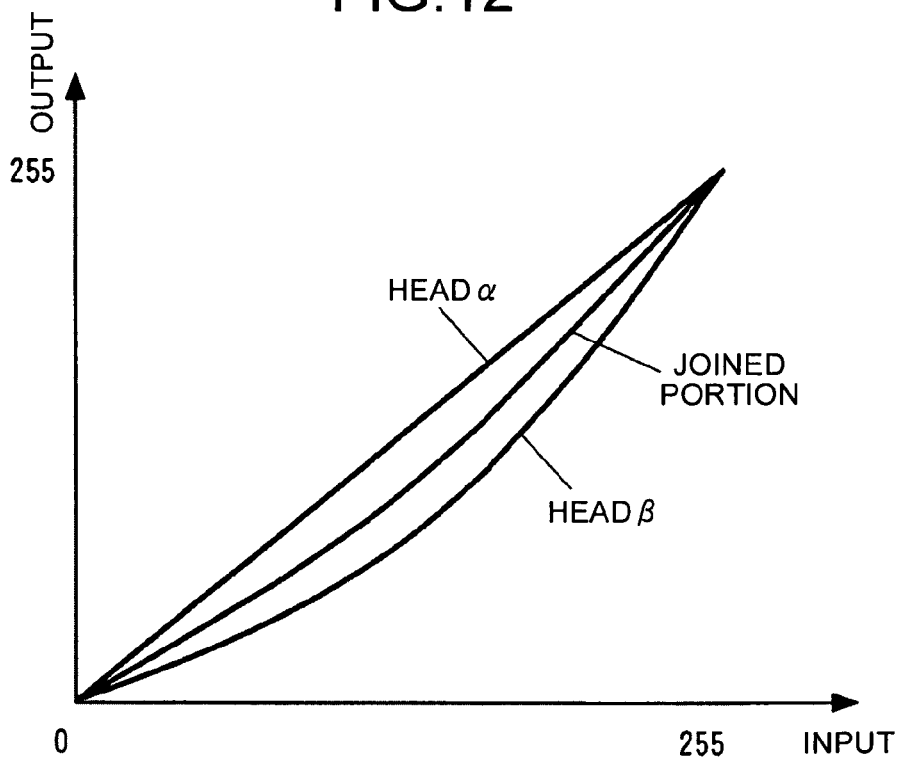
FIG. 12 is a diagram illustrating an example of a tone correcting characteristic of a joint head of an image forming apparatus according to an embodiment of the present invention.
Figure 13:
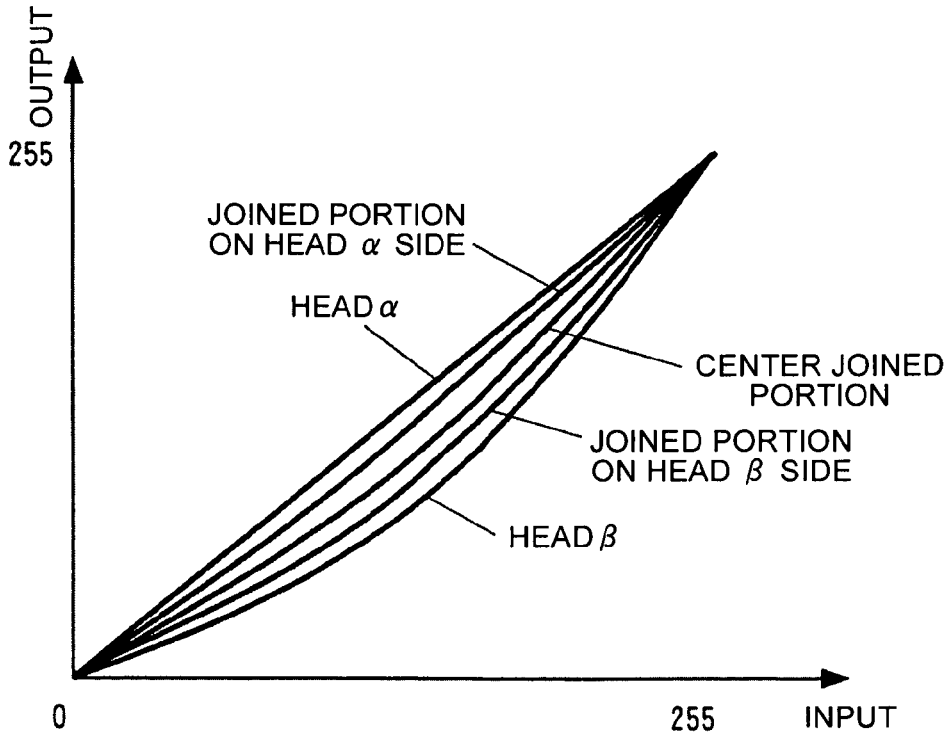
FIG. 13 is a diagram illustrating another example of a tone correcting characteristic of a joint head of an image forming apparatus according to an embodiment of the present invention.

FIG. 11 is a diagram illustrating an example of the joint head according to this embodiment and the dot pattern thereof, and FIGS. 12 and 13 are diagrams illustrating input/output characteristics (tone correcting characteristics) of the joint head. In FIG. 12, the horizontal axis represents the input tone value, and the vertical axis represents the output tone value. In addition, "head α" is the correction characteristic of the recording dot pattern data assigned to nozzles of the head α, which is shown in FIG. 11, that are located at an area other than the overlapping portion, "head β" is the correction characteristic of the recording dot pattern data assigned to nozzles of the head β that are located at an area other than the overlapping portion, and "joint" is the correction characteristic of the recording dot pattern data assigned to the nozzles of the overlapping portion (joined portion).

Based on the input/output characteristics (γ correction characteristics) of the head α and the head β, an intermediate (for example, a center) characteristic (the characteristic of the "joined portion") thereof is generated, and the joined portion is corrected to by the intermediate characteristic. In addition, in this figure, although one intermediate characteristic is prepared, a plurality of intermediate characteristics may be prepared in accordance with the position in the joined portion (overlapping portion). In a case where the plurality of intermediate characteristics are prepared, the correction characteristic of the joined portion which is farther from the ends of the head α and the head β is continuously or stepwise set to be closer to the correction characteristics of the head α and the head β.

FIG. 13 illustrates a case where the joined portion is divided into three portions including a center portion, a joined portion located on the head α side, and a joined portion located on the head β side, and an intermediate characteristic is prepared for each portion. Here, the characteristic of the center portion has a center value (median value) of the input/output characteristics of the head α and the head β, the joined portion located on the head α side has an intermediate value (middle value) of the center value and the characteristic of the head α, and the joined portion located on the head β side has an intermediate value of the center value and the characteristic of the head β.

With the structure as in FIG. 11 or 12, as seen from the dot pattern of "intermediate dot arrangement of heads α/β" in the dot pattern D4 illustrated in FIG. 11, in the joined portion, both characteristics of the head α and the head β are mixed in the dots and the dot arrangement, so that the color unevenness or a change in the pattern can be formed not to be easily visually noticeable.

For the input/output characteristics (correction parameters) illustrated in FIGS. 11 and 12, the discharge characteristics of the heads are acquired by measuring the color of the tone patch printed by the joint head by using a colorimeter such as a spectroscopic colorimetric density meter, and the correction parameter to be applied to each head and the joined portion can be generated. In addition, similarly to the colorimeter, it may be configured such that the red-green-blue (RGB) values or the luminance values are measured by using a scanner, an optical sensor, or the like, and the correction parameter is generated by acquiring the discharge characteristics of the head based on the RGB values or the luminance values.

The generation of the correction parameter may be performed in a process such as the production process, the shipment process, or the like of the image forming apparatus. However, by mounting a colorimeter, a scanner, a sensor, or the like in the image forming apparatus, the color unevenness can be corrected even when the discharge characteristics of the heads change in accordance with the elapse of time or a change in the environment.

Recently, since image forming apparatuses (multi-function printers) in which a scanner is mounted are commercially available, it may be configured such that a predetermined tone patch is output (printed) by the image forming apparatus, the output tone patch is read in by the mounted scanner, and the correction parameter is generated based on the read data.

Recording Medium of Program

As examples of a recording medium on which a program and data are stored for allowing the image forming apparatus 500 to perform the tone correction and the overlapping process described above, there are a compact disc read-only memory (CD-ROM), a magneto optical disk, a digital versatile disk read-only memory (DVD-ROM), a flexible disc, a flash memory, a memory card, a memory stick, and other various types of ROMs and RAMs. By configuring the recording medium to allow the computer (the CPU 201, the ROM 202, the RAM 203, or the like) of the image forming apparatus 500 to perform the above-described process of this embodiment and recording and distributing a program realizing the functions of the above-described image forming apparatus, the functions can be realized in an easy manner.

Modified Examples

Until now, although the image processing apparatus 400 has been configured such that the printer driver allows the computer to perform image processing, the image forming apparatus 500 may be configured so as to perform the above-described image processing. In addition, an ASIC that performs the image processing according to this embodiment may be mounted in the image forming apparatus 500. By configuring the correction process to be performed by using only the main body, the apparatus can independently perform a calibration process even in a case where there is no host computer.

In addition, in the above-described embodiment, a head that discharges ink by applying pressure to the piezoelectric element has been described. However, the configuration of the head is not limited thereto, and the present invention can be applied to a thermal-type inkjet apparatus in which ink is discharged by applying pressure using a thermal element.

In the above-described embodiment, although the image forming apparatus including a serial type head in which two heads are connected in the sub-scanning direction has been described as an example, the number of the heads may be three or more. In addition, the present invention can be applied to a line-type head as illustrated in FIG. 14. As illustrated in the figure, by connecting ten head units in the widthwise direction of a recording sheet, a joint head in which nozzles are arranged over the entire width of the recording sheet is configured. In the case of a long line-type head, since there are many heads that are connected, the above-described problems of the color unevenness and the positional misalignment are more severe, and such a case is an example in which the present invention is especially effective. The operation of this joint head can be described by the operation of the serial-type head described with reference to FIGS. 1 to 11 with the main-scanning and the sub-scanning being interchanged.

There is a need to prevent the generation of a density stripe by improving the dot diameter and the dot arrangement in an overlapping portion, when tone correction for each head and formation of dots by using nozzles of adjacent heads in a shared manner are performed in a joint head in which a plurality of heads, each having a plurality of nozzles arranged in a predetermined direction, are arranged in nozzle arranging direction, and end portions of the heads adjacent to each other overlap.

According to the present embodiment, a joint head has a plurality of heads, each having a plurality of nozzles arranged in a predetermined direction, are arranged in the nozzle arranging direction, and end portions of heads adjacent to each other overlap. Out of recording dot pattern data, the recording dot pattern data used for forming dots by using the nozzles located in the overlapping portion of the adjacent heads is distributed to the nozzles of the adjacent recording heads. A tone correction by a first correction characteristic is performed to the recording dot pattern data used for forming dots by using the nozzles other than the nozzles located in the overlapping portion, and a tone correction by a second correction characteristic, which is intermediate between the first correction characteristics of the adjacent heads, is performed to the recording dot pattern data used for forming dots by using the nozzles located in the overlapping portion.

According to the present embodiment, a joint head has a plurality of heads, each having a plurality of nozzles arranged in a predetermined direction, are arranged in the nozzle arranging direction, and end portions of the heads adjacent to each other overlap. In the joint head according to the present embodiment, the generation of a density stripe can be prevented by improving the dot diameter and the dot arrangement in the overlapping portion, when tone correction for each head and formation of dots by using nozzles of adjacent heads in a shared manner are performed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a first recording head including a first plurality of nozzles;

a second recording head including a second plurality of nozzles, the second recording head having second characteristics that differ from first characteristics of the first recording head, the first recording head and the second recording head having a common overlapping portion, a first portion of the first plurality of nozzles being in the overlapping region and a second portion of the second plurality of nozzles being in the overlapping region, the first recording head and the second recording head being adjacent to each other;

a recording data distributing unit configured to distribute recording data to the first and second portions of nozzles in the common overlapping portion so as to form an image based on image data;

a first tone correcting unit configured to perform tone correction for a region other than the overlapping region, the first tone correcting unit configured to perform tone correction to the first recording head by using first correction characteristics, and to the second recording head by using second correction characteristics; and a second tone correcting unit configured to perform tone correction for the overlapping portion using third correction characteristics, the third correction characteristics being between the first correction characteristics and the second correction characteristics.

2. The image forming apparatus according to claim 1, wherein the third correction characteristics include a plurality of correction characteristics according to a position of the overlapping portion.

3. The image forming apparatus according to claim 1, further comprising:

a unit that causes the first and second recording head to form an image patch;

a unit that acquires a colorimetric value of the image patch; and a unit that calculates a tone correction value to be assigned to each of the first and second recording heads and a tone correction value to be assigned to the overlapping portion based on the colorimetric value.

4. The image forming apparatus according to claim 1, wherein the third correction characteristics are centered between the first correction characteristics and the second correction characteristics.

5. A method of processing an image that is used in an image forming apparatus having a first recording head including a first plurality of nozzles, a second recording head including a second plurality of nozzles, the second recording head having second characteristics that differ from first characteristics of the first recording head, the first recording head and the second recording head having a common overlapping portion, a first portion of the first plurality of nozzles being in the overlapping region and a second portion of the second plurality of nozzles being in the overlapping region, the first recording head and the second recording head being adjacent to each other, the method comprising:

distributing recording data to the first and second portions of nozzles in the common overlapping portion so as to form an image based on image data;

performing tone correction, by a first correcting unit, to a region other than the overlapping region, the first tone correcting unit configured to perform tone correction to the first recording head by using first correction characteristics, and to the second recording head by using second correction characteristics; and performing tone correction, by a second correcting unit, for the overlapping portion using third correction characteristics, the third correction characteristics being between the first correction characteristics and the second correction characteristics.

6. A non-transitory computer-readable recording medium having a program including instructions for causing a computer to execute an processing of an image by an image forming apparatus having a first recording head including a first plurality of nozzles, a second recording head including a second plurality of nozzles, the second recording head having second characteristics that differ from first characteristics of the first recording head, the first recording head and the second recording head having a common overlapping portion, a first portion of the first plurality of nozzles being in the overlapping region and a second portion of the second plurality of nozzles being in the overlapping region, the first recording head and the second recording head being adjacent to each other, the instructions comprising:

distributing recording dot pattern data used for forming dots by using nozzles of an overlapping portion of the heads adjacent to each other out of recording dot pattern data to the nozzles of the recording head adjacent to each other;

performing tone correction, by a first correcting unit, to a region other than the overlapping region, the first tone correcting unit configured to perform tone correction to the first recording head by using first correction characteristics, and to the second recording head by using second correction characteristics; and performing tone correction, by a second correcting unit, for the overlapping portion using third correction characteristics, the third correction characteristics being between the first correction characteristics and the second correction characteristics.

* * * * *